US005823206A

United States Patent [19]

Mapleback

[11] Patent Number: 5,823,206

[45] Date of Patent: Oct. 20, 1998

[54] LOTION APPLICATOR

[76] Inventor: Mark H. Mapleback, 177 Poppy St., Golden, Colo. 80401

[21] Appl. No.: 743,278

[22] Filed: Nov. 4, 1996

[51] Int. Cl.[6] ..... A45D 40/26

[52] U.S. Cl. ..... 132/320; 132/311; 401/6; 401/140; 15/144.2

[58] Field of Search ..... 132/207, 317, 132/320, 218, 286; 401/6, 207, 205, 140, 320, 290; 15/244.2, 144.2, 244.1, 244.3, 244.4

[56] References Cited

U.S. PATENT DOCUMENTS

| | | | |
|---|---|---|---|
| D. 277,512 | 2/1985 | Colognari | D28/63 |
| D. 280,448 | 9/1985 | Colognari | D28/63 |
| D. 280,449 | 9/1985 | Colognari | D28/63 |
| 2,705,499 | 4/1955 | Breeze | 132/207 |
| 3,568,237 | 3/1971 | Rhodes | 15/244 |
| 4,299,005 | 11/1981 | Brown | 401/6 |
| 4,483,356 | 11/1984 | Kales | 132/320 |
| 4,483,636 | 11/1984 | Meyer | 132/320 |
| 5,230,579 | 7/1993 | Klawson et al. | 401/205 |
| 5,240,339 | 8/1993 | DeForest et al. | 401/6 |
| 5,311,635 | 5/1994 | Moore | 15/244.3 |
| 5,353,819 | 10/1994 | Kahn et al. | 132/320 |
| 5,597,255 | 1/1997 | Yager et al. | 401/205 |

*Primary Examiner*—Gene Mancene
*Assistant Examiner*—Pedro Philogene
*Attorney, Agent, or Firm*—David L. Volk

[57] ABSTRACT

A lotion bottle is configured to be removably engaged to a handle portion, the handle portion is connected to a head, and a pad is configured to be removably attachable to the head. The handle portion includes a plurality of removably engageable segments. The head is threadedly connected to the handle portion, the head including a flow control device therein, the flow control device having structure forming flow control ports therein, the head, the handle segment and the flow control device configured such that the flow control ports are open when the handle segment is in its most distal position from the head, and the flow control ports are closed when the handle segment is in its nearest position to the head.

2 Claims, 6 Drawing Sheets

LOTION APPLICATOR

BACKGROUND OF THE INVENTION

1. Field of the Invention

The present invention relates to lotion applicators, specifically to a device for applying lotion to a human body.

2. Description of the Related Art

It is impossible, without the aid of some kind of apparatus, to apply lotion evenly to all areas of one's own back. This can be a particular problem for people who wish to apply protective lotions or oils when sunbathing or otherwise participating in outdoor activities. Unprotected areas of the back exposed to the sun can become burned, and may lead to skin cancer in some people and in some instances.

What is needed is a device for effectively applying lotion to one's own back or other difficult to reach areas. It would be particularly advantageous if such a device included an easily changeable pad for ease in cleaning and maintaining the device. It would also be an advantage if such a device included an adjustable length arm so that persons of various sizes could effectively use the device. Such a device would be particularly convenient if a large supply of lotion could be kept in the device at all times, while controlling the amount of lotion that actually saturates the applicator pad at any given time.

SUMMARY OF THE INVENTION

The lotion applicator of the present invention includes a lotion bottle configured to be removably engaged to a handle portion. The handle portion is connected to a head, and a pad is configured to be removably attachable to the head. The handle portion includes a plurality of removably engageable segments. The head is threadedly connected to the handle portion, the head including a flow control device therein, the flow control device having structure forming flow control ports therein, the head, the handle segment and the flow control device configured such that the flow control ports are open when the handle segment is in its most distal position from the head, and the flow control ports are closed when the handle segment is in its nearest position to the head.

Accordingly, several objects and advantages of the present invention are:

a. to provide a lotion applicator with an easily changeable pad for ease in maintaining and cleaning the device;

b. to provide a lotion applicator with an adjustable length arm so that persons of various sizes can effectively use the device;

c. to provide a lotion applicator which maintains a large supply of lotion incorporated therein for added convenience; and d. to provide a lotion applicator which permits a user to control the amount of lotion that actually saturates the applicator pad at any given time.

Still further objects and advantages will become apparent from the ensuing description and drawings.

DETAILED DESCRIPTION

Figure 1:
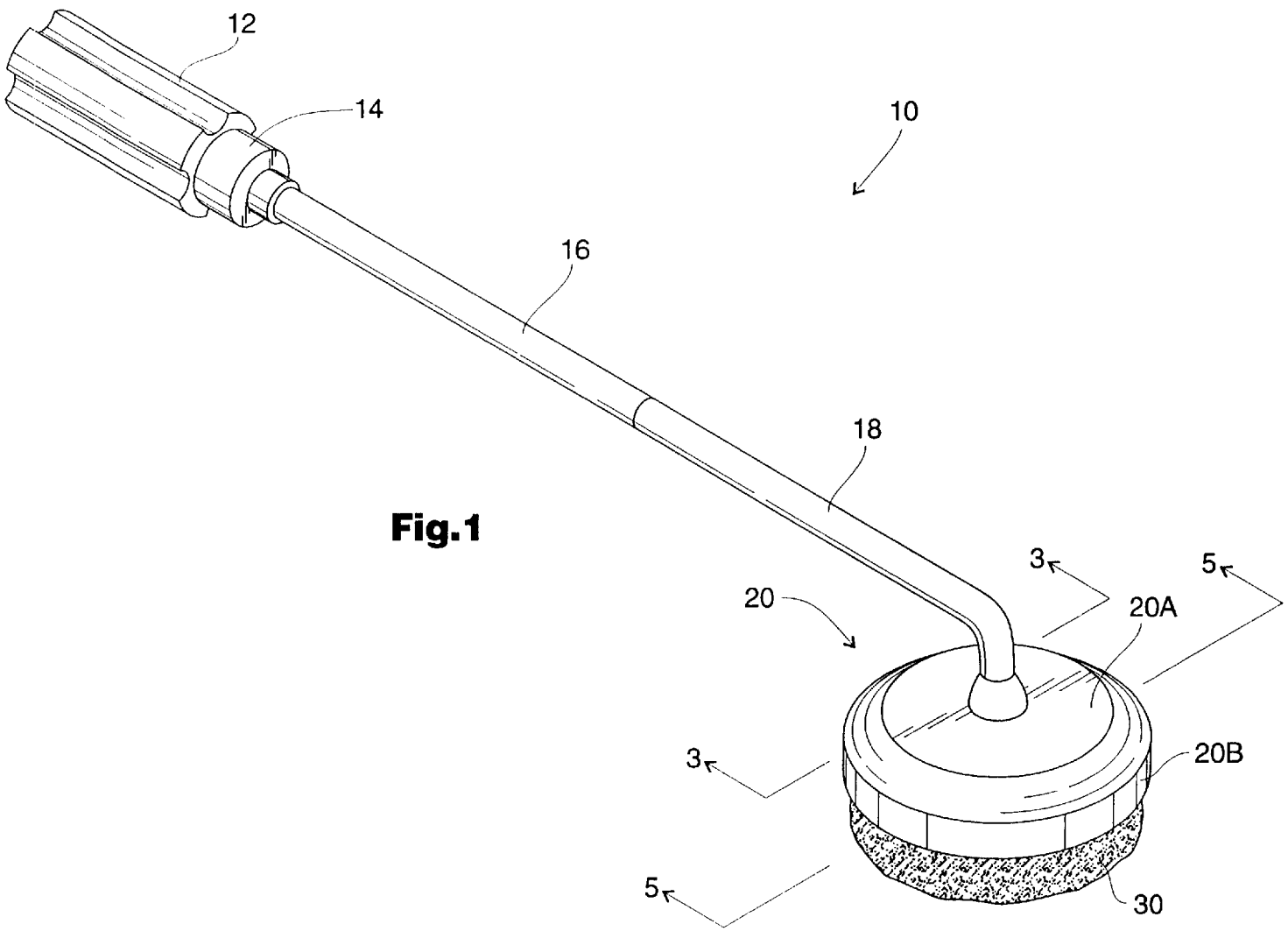
FIG. 1 is a perspective view of the lotion applicator.

FIG. 1 is a perspective view of a lotion applicator 10, including a lotion bottle 12, an adapter 14, a first handle segment 16, a second handle segment 18, a head 20 and a resilient, absorbent pad 30.

Figure 2:
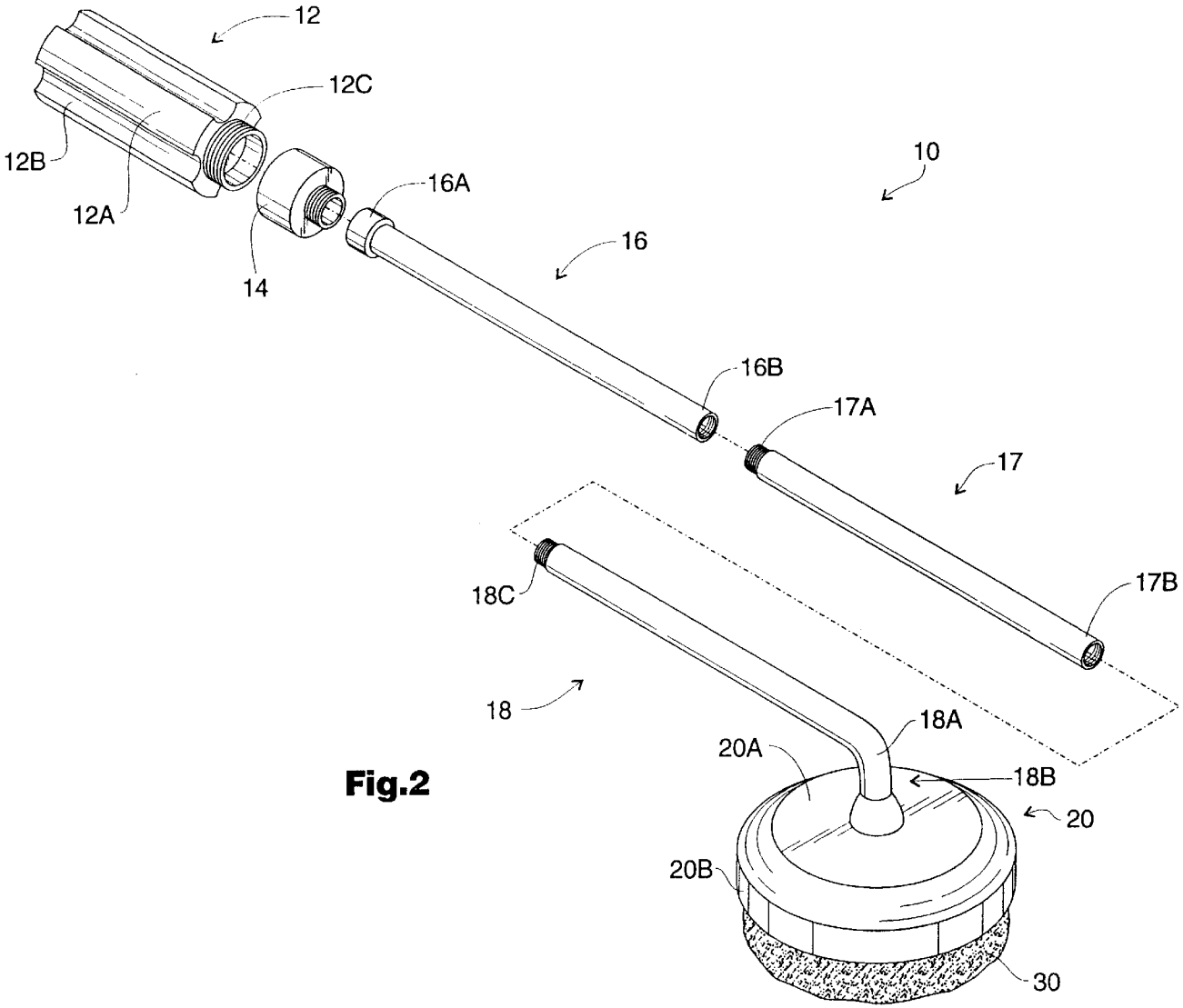
FIG. 2 is an exploded perspective view of the lotion applicator.

FIG. 2 is an exploded perspective view of the lotion applicator 10. The lotion bottle 12 includes longitudinal, alternately raised surfaces 12A and lowered surfaces 12B disposed about the circumference thereof to facilitate handling thereof. The bottle 12 includes a male threaded mouth 12C, through which lotion from any conventional container (not shown) may be poured into the bottle 12.

The adapter 14 is configured to threadedly engage the male threaded mouth 12C to a first female threaded end 16A of the first handle segment 16. The adapter 14 is open axially there-through to permit lotion (not shown) to flow from the bottle 12 through the adapter 14 into the first handle segment 16.

The first handle segment 16A is substantially straight and hollow pipe shaped, being configured to permit lotion (not shown) to flow there-through. The first handle segment 16 includes the first female threaded end 16A and a second female threaded end 16B.

A third handle segment 17 may be inserted between the first handle segment 16 and the second handle segment 18 to lengthen the lotion applicator 10 when desirable, such as for use by a large person. The third handle segment 17, like the first handle segment 16 is substantially straight and hollow pipe shaped, being configured to permit lotion (not shown) to flow there-through. The third handle segment 17 includes a male threaded end 17A and a female threaded end 17B. The male threaded end 17A is configured to threadedly engage the second female threaded end 16B of the first handle segment 16.

The second handle segment 18 is substantially hollow pipe shaped, being configured to permit lotion (not shown) to flow there-through. The second handle segment 18 is substantially straight except for a bend 18A at a head end 18B thereof. The second handle segment 18 includes a first male threaded end 18C configured to threadedly engage the female threaded end 17B of the third handle segment 17 and alternatively, the second female threaded end 16B of the first handle segment 16.

Figure 3:
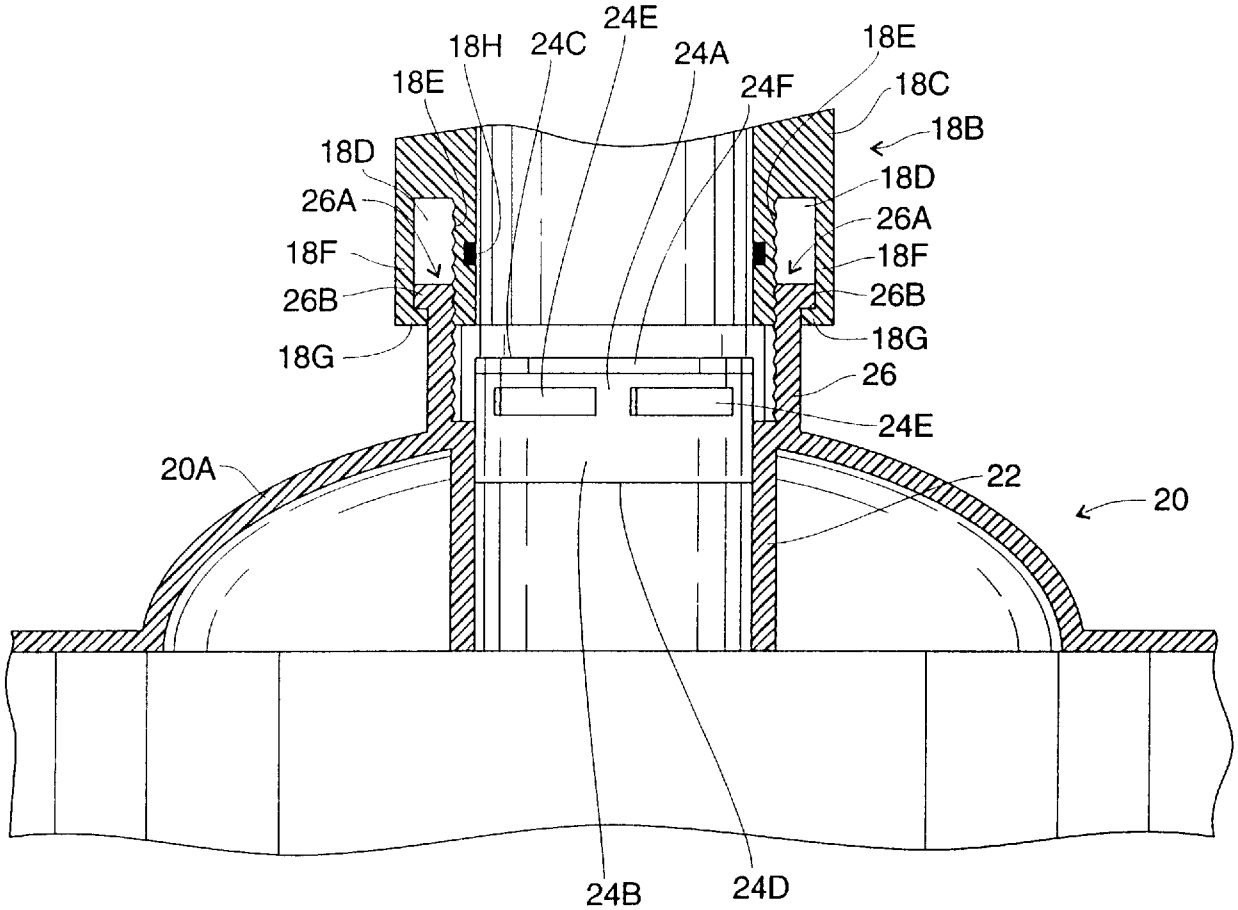
FIG. 3 is a partial cross-sectional view of the lotion applicator, taken along line 3—3 of FIG. 1, showing the flow control ports in an open position.

FIG. 3 is a partial cross-sectional view of the lotion applicator 10, taken along line 3—3 of FIG. 1. This view shows the head end 18B of the second handle segment 18, and the head 20. The head 20 includes a first pipe 22 in the approximate center of the top portion 20A thereof. Snugly fitting partially within the first pipe 22 is a cup-shaped flow control device 24.

The flow control device 24 includes a first portion 24A which extends beyond the first pipe 22 and a second portion 24B which is contiguous with the first portion 24A and which is snugly fitted within the first pipe 22. The first portion 24A includes a closed end 24C which faces away from the head 20, and the second portion 24B includes an open end 24D which faces toward the head 20.

The first pipe 22 turns radially outward and then turns at a substantially right angle to form a second pipe 26 which shares a common central axis with the first pipe 22. The second pipe 26 is internally threaded and turns radially outward at its distal end 26A to form a first lip 26B.

The first portion 24A of the flow control device 24 includes structure forming flow control ports 24E therein. The flow control ports 24E are disposed circumferentially about the flow control device 24.

The first portion 24A of the flow control device 24 further includes a first seal 24F circumferentially disposed about the flow control device 24 and positioned adjacent the closed end 24C.

A second handle segment wall 18C includes structure forming a notch 18D configured to receive the second pipe wall 26C therein. An inner wall 18E of the notch 18D is externally threaded to engage the second pipe 26. An outer wall 18F of the notch 18D is turned inwardly to form a second lip 18G, positioned and configured to engage the first lip 26B of the second pipe 26 in a manner to prevent the second handle segment 18 from being completely removed from the second pipe 26.

In FIG. 3, the first and second lips 26B, 18C are engaged, and the second handle segment 18 in its most distal position from the head 20. In this position, lotion (not shown) may flow from the second handle segment 18 around the closed end 24C of the flow control device 24 and through the flow control ports 24E. The lotion (not shown) may then flow through the open end 24D of the flow control device 24 into and through the first pipe 22.

Figure 4:
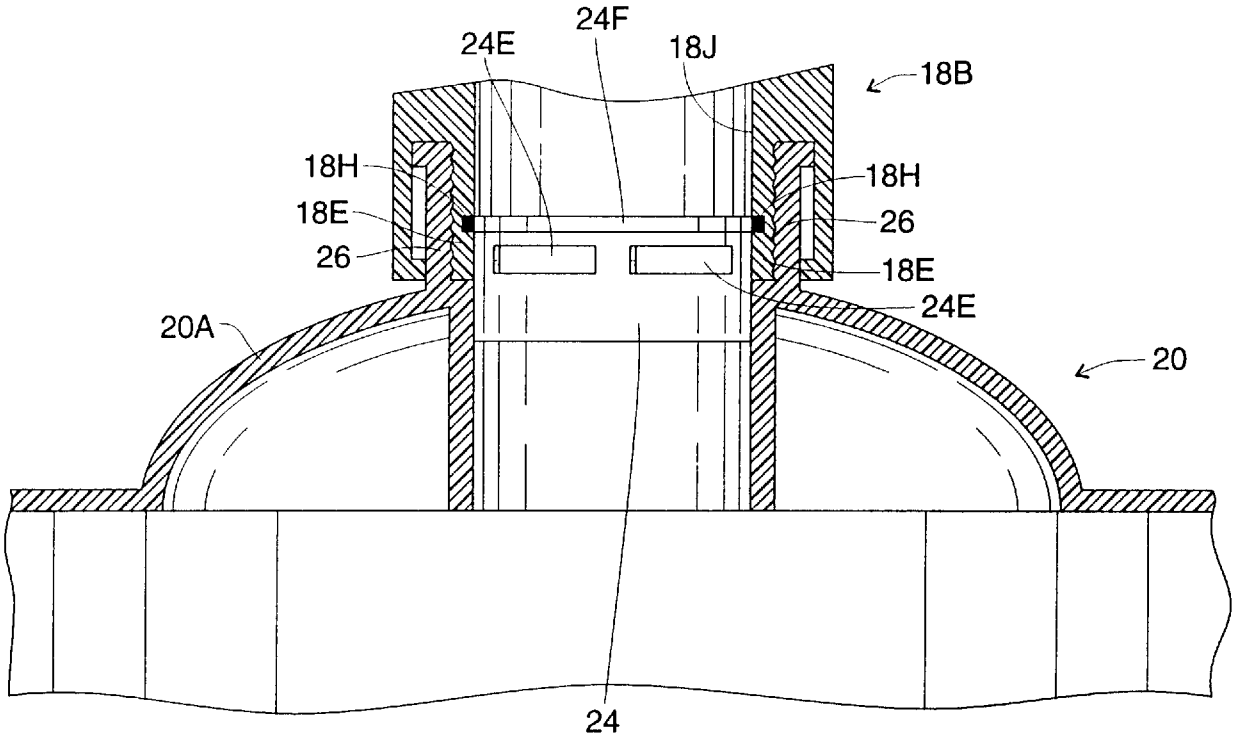
FIG. 4 is a partial cross-sectional view similar to FIG. 3, showing the flow control ports in a closed position.

FIG. 4 is a partial cross-sectional view similar to FIG. 3, showing the flow control ports 24E in a closed position. In this position, the flow control ports 24E are closed off by the inner wall 18E, and the second handle segment 18 is in its nearest position to the head 20. In this position, a second seal 18H dipsosed circumferentially about an inward facing surface 18J of the inner wall 18E mates with the first seal 24F. In this position, the lotion (not shown) is prevented by the flow control device 24 from flowing from the second handle segment 18 into the second pipe 26.

Figure 5:
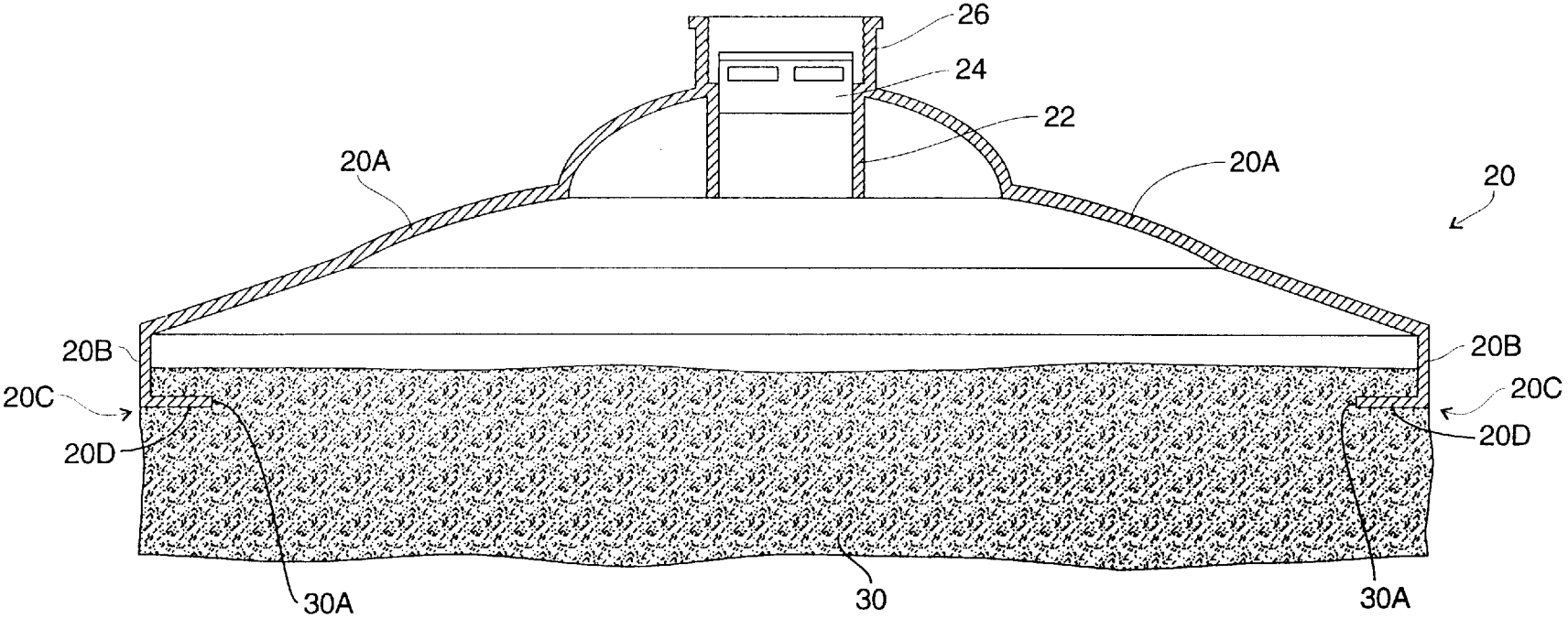
FIG. 5 is a partial cross-sectional view of the lotion applicator, taken along line 5—5 of FIG. 1.

FIG. 5 is a partial cross-sectional view of the lotion applicator 10, taken along line 5—5 of FIG. 1. In this view, the second handle segment 18 is not shown for clarity. The top portion 20A extends outward and tapers downward to a circular skirt 20B. The skirt 20B turns inward at its skirt distal end 20C to form a third lip 20D, continuously disposed about the perimeter of the skirt 20B.

The absorbent pad 30 includes structure forming a pad notch 30A circumferentially disposed thereon, the pad notch 30A configured and positioned to receive the third lip 20D, thereby securing the pad 30 to the head 20. The absorbent pad 30 may be made of natural or artificial sponge, or other suitable material.

Lotion (not shown) flows out of the first pipe 22 into the space between the top portion 20A of the head and the absorbent pad 30, and then onto the absorbent pad 30.

Figure 6:
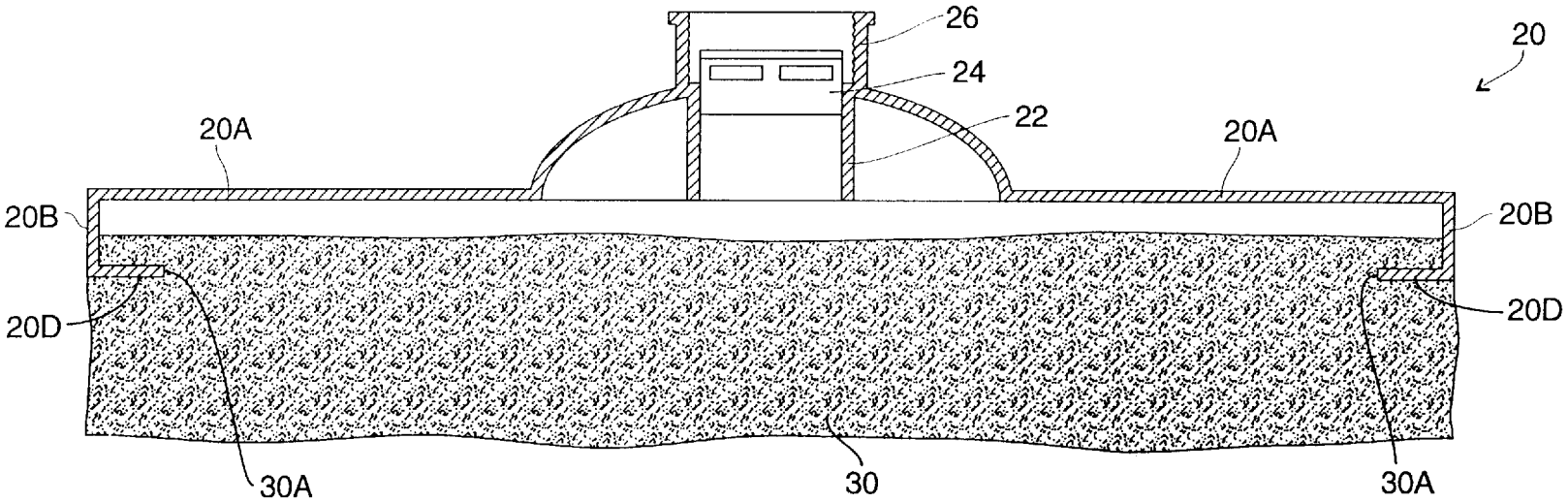
FIG. 6 is a partial cross-sectional view of the lotion applicator similar to FIG. 5, showing a different embodiment.

FIG. 6 is a partial cross-sectional view of the lotion applicator similar to FIG. 5, showing a different embodiment wherein the head 20, flow control device 24, and absorbent pad 30 are differently sized in proportion to one another, and the top portion 20A of the head 20 is somewhat differently shaped. In this particular embodiment, the first pipe 22 is positioned more closely to the absorbent pad 30. The purpose of FIG. 6 is to illustrate that various sizes and shapes of the various components of the lotion applicator 10 are within the scope of the present invention.

To use the invention, a user places lotion into the lotion bottle 12, and engages the lotion bottle 12 to the first handle segment 16. The user then tilts the lotion applicator 10 to permit lotion to flow through the first, second and third handle segments 16, 17, 18 to the head 20, where it contacts the absorbent pad 30. The pad 30 is sufficiently porous for the lotion to make its way into the pad 30 where it can applied to a user's body. A user may apply lotion directly to the absorbent pad 30 initially, in which case the lotion flowing through the handle segments 16, 17, 18 to the pad 30 will replace lotion as it is used. When the user wishes the lotion to flow freely to the pad, he or she twists the second handle segment 18 in relation to the head 20 until the first and second lips 26B, 18C are engaged. In this position, the flow control ports 24E are open, permitting lotion to flow through. To close off flow of lotion to the pad 30, the user twists the second handle segment 18 in relation to the head 20 until the second handle segment 18 is in its nearest position to the head 20 and the flow control ports 24E are closed.

The pad 30 is easily removed from the head 20 by squeezing the pad 30 until the third lip 20D is disengaged from the pad notch 30A. To replace the pad 30, a user squeezes the pad 30, then inserts the pad 30 within the skirt 20B of the head 20 and releases the pad 30 to permit the third lip 20D to engage within the pad notch 30A.

The foregoing description is included to describe embodiments of the present invention which include the preferred embodiment, and is not meant to limit the scope of the invention.

From the foregoing description, many variations will be apparent to those skilled in the art that would be encompassed by the spirit and scope of the invention. The scope of the invention is to be limited only by the following claims and their legal equivalents.

The invention claimed is:

1. A lotion applicator comprising:

a. a lotion bottle;

b. a hollow handle, the lotion bottle being attachable to the handle;

c. a head configured to be connected to the handle;

d. an applicator pad which is attachable to the head;

e. the handle including at least three elongated segments;

f. the handle being capable of being shortened by completely separating at least one of the segments from remaining ones of the segments;

g. wherein lotion is flowable from the lotion bottle, through the handle, then through the head to the pad.

2. A lotion applicator comprising:

a. a lotion bottle;

b. a hollow handle comprising a first segment, a second segment, and a third segment;

c. the lotion bottle being attachable to a first end of the first segment;

d. a second end of the first segment being attachable to a first end of the third segment;

e. a second end of the third segment being attachable to a first end of the second segment;

f. a head configured to be connected to a second end of the second segment;

g. an applicator pad which is attachable to the head;

h. the handle being capable of being shortened by completely separating the third segment from the first segment and the second segment, and attaching the second end of the first segment to the first end of the second segment;

i. wherein lotion is flowable from the lotion bottle, through the handle, then through the head to the pad.

* * * * *